US010710103B2

(12) United States Patent
Lawyer et al.

(10) Patent No.: US 10,710,103 B2
(45) Date of Patent: Jul. 14, 2020

(54) SERVICEABLE SPRINKLER WITH A NUTATING DEFLECTOR ASSEMBLY

(71) Applicant: Senninger Irrigation, Inc., Clermont, FL (US)

(72) Inventors: Jerry D. Lawyer, Clermont, FL (US); Jay C. Huberty, Orlando, FL (US)

(73) Assignee: Senninger Irrigation, Inc., Clermont, FL (US)

( * ) Notice: Subject to any disclaimer, the term of this patent is extended or adjusted under 35 U.S.C. 154(b) by 71 days.

(21) Appl. No.: 15/948,900

(22) Filed: Apr. 9, 2018

(65) Prior Publication Data

US 2018/0311684 A1 Nov. 1, 2018

Related U.S. Application Data

(60) Provisional application No. 62/491,543, filed on Apr. 28, 2017.

(51) Int. Cl.
*B05B 1/26* (2006.01)
*B05B 3/04* (2006.01)
*B05B 3/00* (2006.01)

(52) U.S. Cl.
CPC ..... *B05B 1/265* (2013.01); *B05B 3/008* (2013.01); *B05B 3/0486* (2013.01)

(58) Field of Classification Search
CPC ..... B05B 1/26; B05B 1/265; B05B 1/267; B05B 3/008; B05B 3/0486
USPC ..... 239/222.11, 222.17, 222.21
See application file for complete search history.

(56) References Cited

U.S. PATENT DOCUMENTS

| | | | | |
|---|---|---|---|---|
| 5,234,169 | A | 8/1993 | McKenzie | |
| 5,699,962 | A | 12/1997 | Scott | |
| 6,199,771 | B1 * | 3/2001 | Clearman | B05B 3/008 239/222.11 |
| 6,341,711 | B1 | 1/2002 | Blake | |
| 6,439,477 | B1 | 8/2002 | Sweet | |
| 6,676,038 | B2 | 1/2004 | Gressett | |
| 6,871,795 | B2 | 3/2005 | Anuskiewicz | |
| 7,037,960 | B2 | 5/2006 | Ukai | |
| 7,287,710 | B1 * | 10/2007 | Nelson | B05B 3/006 239/222.17 |
| 7,562,833 | B2 * | 7/2009 | Perkins | B05B 3/006 239/222.11 |
| 8,556,196 | B2 | 10/2013 | Lawyer et al. | |

(Continued)

*Primary Examiner* — Darren W Gorman
(74) *Attorney, Agent, or Firm* — Knobbe Martens Olson & Bear, LLP

(57) ABSTRACT

A sprinkler assembly can include a water inlet and a nozzle assembly. The nozzle assembly can include a nozzle tube having a nozzle positioned at the downstream end of the nozzle tube. The sprinkler assembly can include a user replaceable wear disc at least partially surrounding the nozzle tube. A deflector assembly can be connected to the nozzle assembly and can include a distribution plate positioned downstream of the nozzle and configured to deflect water from the nozzle. The deflector assembly can include a cage having one or more arms connected to the distribution plate and extending from the distribution plate toward upstream end of the nozzle tube. The deflector assembly can include an upstream collar portion connected to the at least one arm and having one or more load surfaces configured to contact the wear disc, wherein the wear disc is configured to bear at least a majority of a weight of the deflector assembly.

17 Claims, 11 Drawing Sheets

(56) References Cited

U.S. PATENT DOCUMENTS

| | | | | |
|---|---|---|---|---|
| 8,584,969 | B2 | 11/2013 | Drechsel | |
| 8,991,724 | B2 * | 3/2015 | Sesser | B05B 7/12 239/222.11 |
| 2011/0155827 | A1 | 6/2011 | Dreschel | |
| 2013/0327846 | A1 | 12/2013 | Sesser | |
| 2020/0047195 | A1 | 2/2020 | Healy | |

* cited by examiner

SERVICEABLE SPRINKLER WITH A NUTATING DEFLECTOR ASSEMBLY

CROSS-REFERENCE TO RELATED APPLICATION

This application claims benefit under 35 U.S.C. 119(e) to U.S. Provisional Patent App. No. 62/491,543, filed Apr. 28, 2017, the entire disclosure of which is hereby incorporated by reference herein in its entirety. Any and all priority claims identified in the Application Data Sheet, or any corrections thereto, are hereby incorporated by reference under 37 CFR 1.57.

TECHNICAL FIELD

The present inventions relate to apparatuses for irrigating turf, agriculture, and/or landscaping.

BACKGROUND

In many parts of the United States, rainfall is insufficient and/or too irregular to keep turf and landscaping green and/or to sufficiently water crops and other agricultural products and therefore irrigation systems are installed. In many cases, it is desirable increase the useable life of the irrigation systems in order to reduce material and repair costs.

SUMMARY

According to some variants, a sprinkler assembly can include a water inlet. The assembly can include a nozzle assembly in fluid communication with the water inlet. The nozzle assembly can include a nozzle tube having an upstream end and a downstream end. The nozzle can be positioned at the downstream end of the nozzle tube and configured to direct water out from the nozzle tube along a nozzle axis. The assembly can include a user replaceable wear disc at least partially surrounding the nozzle tube at an intermediate position between the upstream and downstream ends of the nozzle tube, the wear disc having an upstream end and a downstream end. In some embodiments, the sprinkler assembly includes a deflector assembly connected to the nozzle assembly. The deflector assembly can include a distribution plate positioned downstream of the nozzle and configured to deflect water from the nozzle. In some embodiments, the deflector assembly includes a cage having one or more arms connected to the distribution plate, the one or more arms extending from the distribution plate toward upstream end of the nozzle tube. The deflector assembly can include an upstream collar portion connected to the at least one arm and at least partially surrounding the nozzle tube, the upstream collar portion having one or more load surfaces configured to contact the wear disc. In some embodiments, the deflector assembly is configured to move with respect to the nozzle axis in one or both of a rotational and a tilting direction. In some embodiments, the wear disc is configured to bear at least a majority of a weight of the deflector assembly. In some embodiments, the downstream end of the wear disc is prevented from moving toward the nozzle during movement of the distribution assembly.

In some embodiments, the sprinkler assembly includes a shroud connected to the water inlet and surrounding at least a portion of the nozzle tube, the shroud having a first end and a second end positioned further from the water inlet than the first end.

In some embodiments, the shroud includes a base portion connected to the water inlet and a removable ring connected to the base portion.

In some embodiments, the removable ring is connected to the base portion via a threaded engagement.

In some embodiments, the removable ring is connected to the base portion via a bayonet fitting.

In some embodiments, the removable ring is connected to the base portion via a snap ring.

In some embodiments, the deflector assembly comprises a contact portion configured to periodically contact the removable ring during movement of the deflector assembly with respect to the nozzle axis.

In some embodiments, no portion of the deflector assembly other than the contact portion contacts the shroud during movement of the deflector assembly with respect to the nozzle axis.

In some embodiments, the contact portion is an annular band.

In some embodiments, the contact portion comprises a plurality of protrusions extending away from the nozzle axis.

According to some variants, a sprinkler assembly includes a nozzle tube having an upstream end connected to a water inlet and a downstream end configured to eject water along a nozzle ejection axis. The sprinkler assembly can include a deflector assembly. The deflector assembly can include a longitudinal axis and a distribution plate positioned along the longitudinal axis. In some embodiments, the deflector assembly includes an upstream portion surrounding a portion of the nozzle tube and supported by the nozzle tube. The deflector assembly can include at least one arm connecting the upstream portion to the distribution plate. In some embodiments, the deflector assembly includes a deflector collar extending at least partially around the deflector assembly. The sprinkler assembly can include a shroud connected to the nozzle tube. The shroud can have a base portion connected to the water inlet and a wear ring removable connected to the base portion and extending from the base portion in a direction opposite the water inlet, the wear ring having a generally cylindrical inner wall. In some embodiments, the deflector assembly is configured to tilt with respect to the nozzle ejection axis such that the longitudinal axis of the deflector assembly is misaligned from the nozzle ejection axis in a plurality of orientations during movement of the deflector assembly. In some embodiments, the deflector collar is configured to contact the inner wall of the wear ring to limit misalignment between the longitudinal axis of the deflector assembly and the nozzle ejection axis.

In some embodiments, the wear ring extends downstream of the base portion to shield wear surfaces from contamination.

According to some variants, a sprinkler assembly can include a nozzle configured to output water along a nozzle ejection axis. In some embodiments, the sprinkler assembly includes a deflector assembly positioned downstream of the nozzle. The deflector assembly can include a longitudinal axis and a distribution plate positioned along the longitudinal axis. In some embodiments, the deflector assembly includes an upstream portion and at least one arm connecting the upstream portion to the distribution plate. In some embodiments, the sprinkler assembly includes a wear ring having an upstream end and a downstream end, the wear ring positioned between the upstream portion of the deflector assembly and the nozzle. In some embodiments, the deflector assembly is configured to tilt with respect to the nozzle ejection axis such that the longitudinal axis of the deflector assembly is misaligned from the nozzle ejection axis in a plurality of orientations during movement of the deflector assembly. In some embodiments, the upstream portion of the deflector assembly contacts the upstream end of the wear ring. In some embodiments, the wear ring is configured to support at least a majority of the weight of the deflector assembly. In some embodiments, the wear ring is constructed from a material softer than the upstream portion of the deflector assembly.

In some embodiments, the sprinkler assembly includes a nozzle tube extending between a water inlet and the nozzle, wherein the nozzle is removably connected to the nozzle tube.

In some embodiments, the nozzle tube further comprises an outward flange, wherein wear ring is configured to surround a portion of the nozzle tube and to be supported by the outward flange.

In some embodiments, the outward flange comprises an upstream surface upon which the wear ring is configured to sit, wherein the upstream surface of the outward flange is not perpendicular to the nozzle ejection axis.

In some embodiments, the nozzle is configured to be removed from the nozzle tube in a direction non-parallel to the nozzle ejection axis.

In some embodiments, the distribution plate is configured to move in one or both of a tilting direction and a rotating direction with respect to the nozzle ejection axis in reaction to impingement of water on the distribution plate.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure.

DETAILED DESCRIPTION

Figure 1:
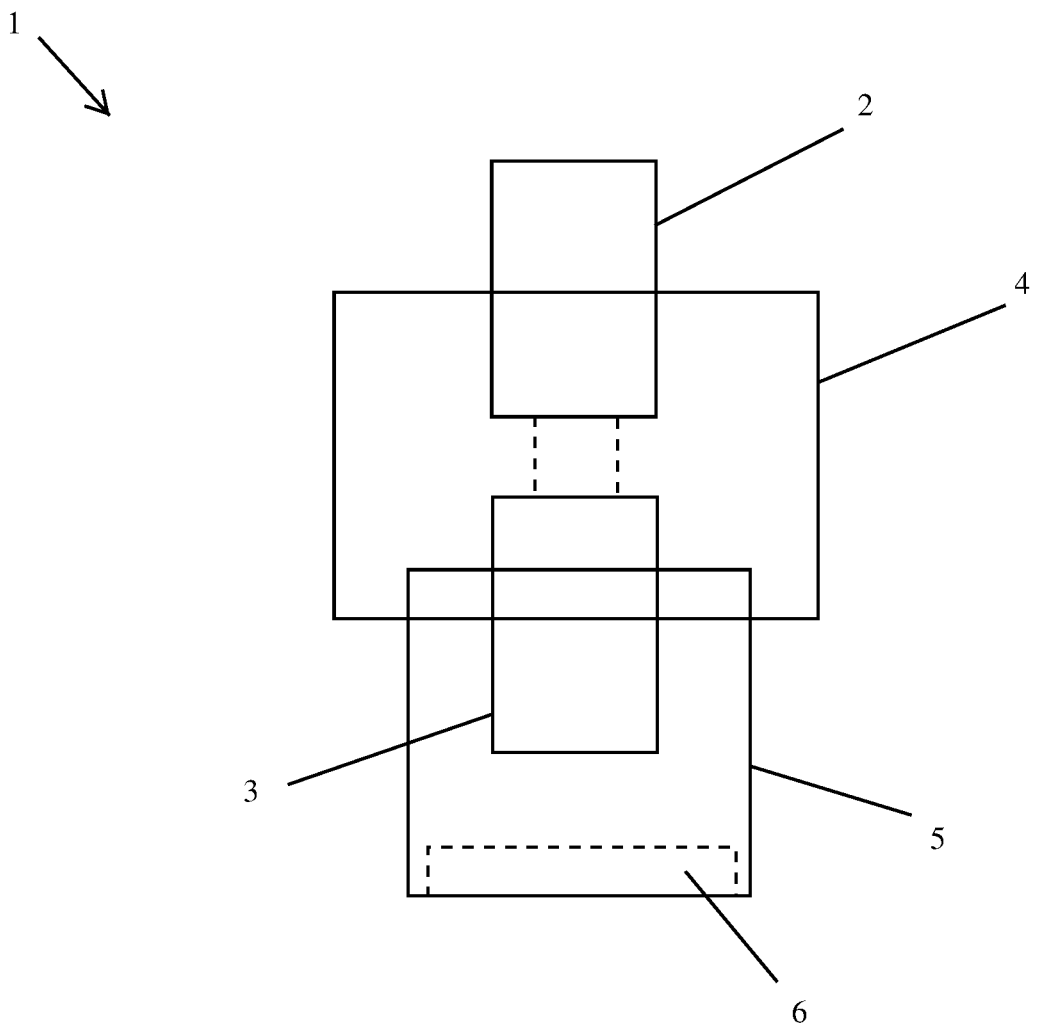
FIG. 1 is a schematic representation of a sprinkler with a nutating deflector assembly.

In certain irrigation applications, it can be advantageous to utilize a sprinkler with a nutating deflector. For example, a sprinkler with a nutating deflector assembly often utilizes fewer parts than a gear driven sprinkler. In many cases, a sprinkler with a nutating deflector assembly is capable of operating using relatively large unobstructed water flow paths for overhead irrigation of large fields and crops. Utilization of larger water flow paths can reduce the need to finely filter or otherwise purify water used for irrigation. In some such cases, water from rivers, streams, lakes, ponds, wells, and/or other water sources can be used with less purification infrastructure than may be necessary for gear driven sprinklers FIG. 1 schematically illustrates an embodiment of a sprinkler 1 with a nutating deflector assembly. The sprinkler 1 can include a water inlet 2. The water inlet 2 can be configured to connect to a water source (e.g., an arm of an irrigation system, a water line, a hose, or some other source of water). The sprinkler 1 can include a nozzle 3 (e.g., a nozzle tube). The nozzle 3 can be in fluid communication with the water inlet 2, as indicated by dotted lines in FIG. 1. The nozzle 3 can be configured to output water, in a pressurized manner in some configurations.

The sprinkler 1 with a nutating deflector assembly can include a shroud assembly 4. The shroud assembly 4 can be connected to the water inlet 2 and/or to the nozzle 3. The shroud assembly 4 can surround a portion of the nozzle 3.

As illustrated the sprinkler 1 can include a deflector assembly 5. The shroud assembly 4 can at least partially overlap the deflector assembly 5 (e.g., in direction parallel to a longitudinal axis of the nozzle 3). The deflector assembly 5 can be supported by one or both of the nozzle 3 and the shroud assembly 4.

The deflector assembly 5 can include a distribution plate 6. The distribution plate 6 can be positioned downstream of the nozzle 3. In some embodiments, the nozzle 3 is configured to direct water onto the distribution plate 6. Water impingement on the distribution plate 6 can cause the deflector assembly 5 to "wobble." For example, the deflector assembly 5 can be configured to rotate and/or tilt with respect to the nozzle 3 or some axis thereof in reaction to water impingement from the nozzle 3 onto the distribution plate 6. Wobbling of the deflector assembly 5 and distribution plate 6 can facilitate even distribution of water about an area of irrigation.

Figure 1A:
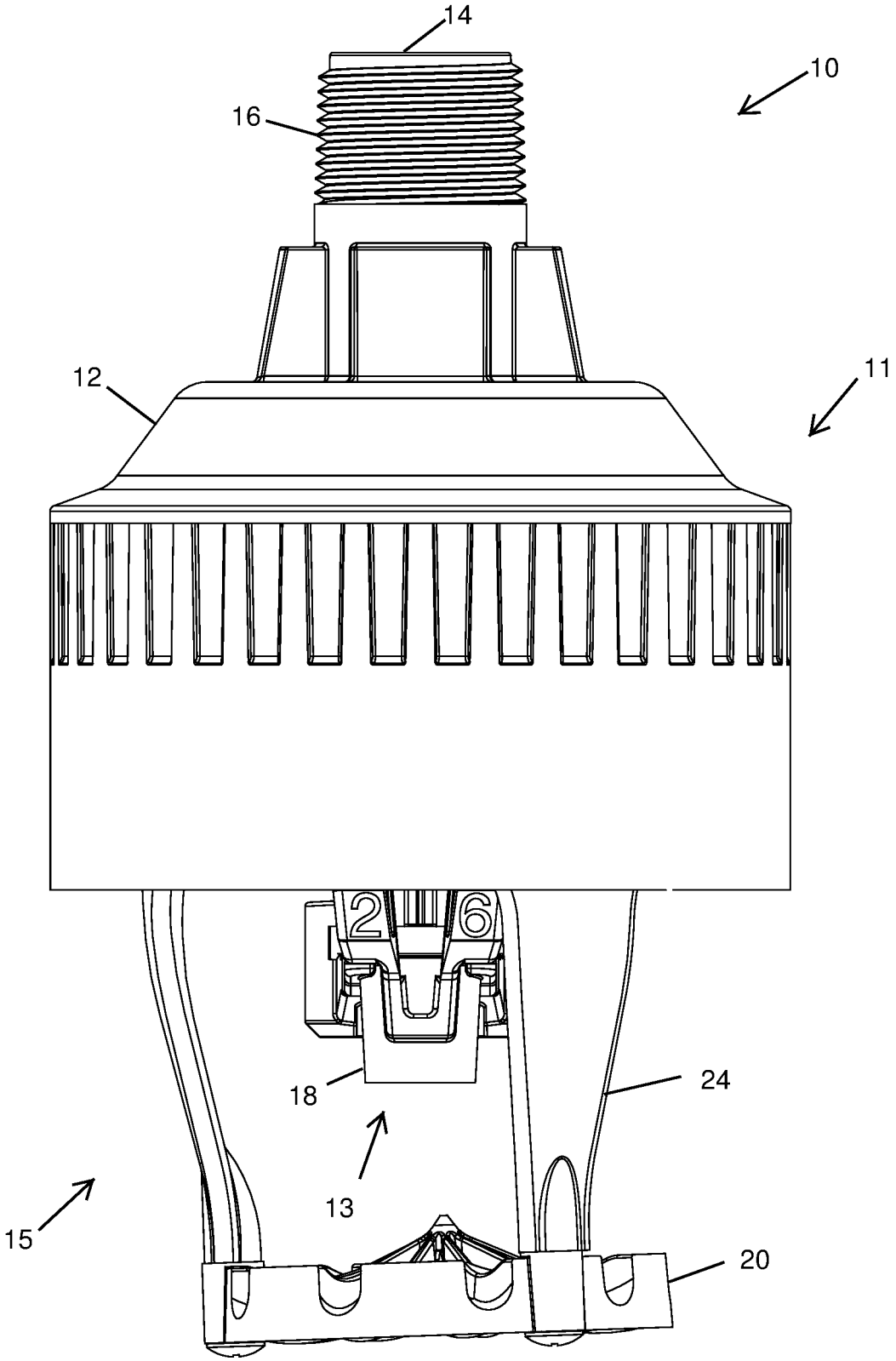
FIG. 1A is a front plan view of an embodiment of a sprinkler with a nutating deflector assembly.

As illustrated in FIG. 1A, a sprinkler 10 (e.g., a sprinkler with a nutating deflector assembly) can include a shroud assembly 11. The shroud assembly 11 can be connected to a water inlet 14. A nozzle assembly 13 can extend at least partially beyond a downstream end of the shroud assembly 11. As illustrated, the sprinkler 10 can include a deflector assembly 15 connected to one or both of the nozzle assembly 13 and the shroud assembly 11.

The shroud assembly 11 can include a shroud base 12. In some embodiments the shroud base 12 is connected to the water inlet 14. In some embodiments, the inlet 14 may be a separate piece that is removably or permanently attached to the shroud base 12. In some embodiments, the inlet 14 may be formed with the shroud base 12. In some embodiments, the inlet 14 may be at least partially surrounded by threads 16. The inlet threads 16 may be screwed into a water supply line on an irrigation system. In some instances, a pressure regulator may be positioned between the water supply line and the sprinkler 10. In such cases, the threaded inlet 16 may be screwed into an outlet of the pressure regulator. Other attachment methods, including, but not limited to, bayonet mounts, snap rings, keys, or collars may be used to secure a sprinkler to either a water supply line or a pressure regulator.

Figure 2:
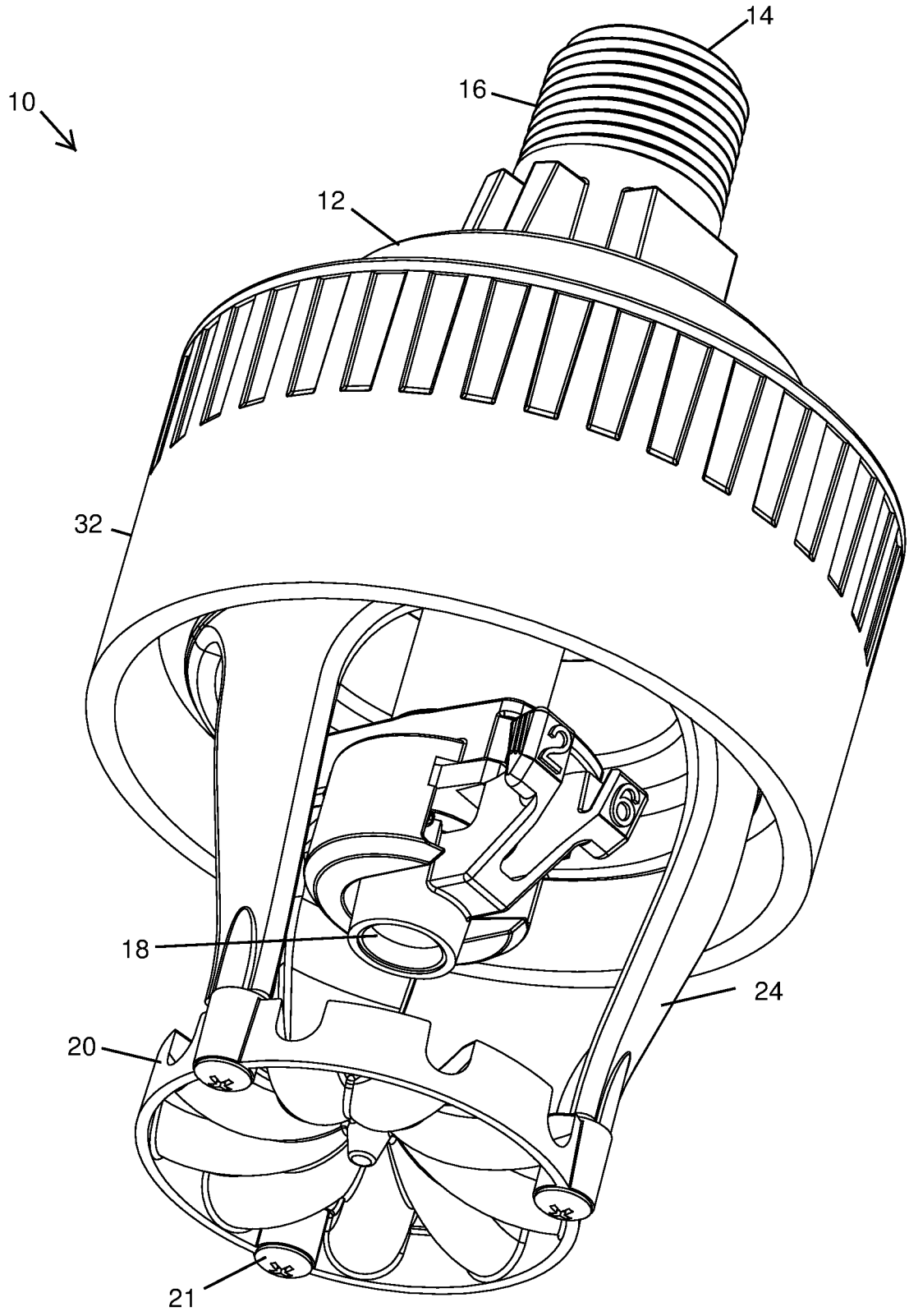
FIG. 2 is a bottom perspective view of the sprinkler with a nutating deflector assembly of FIG. 1A.
Figure 3:
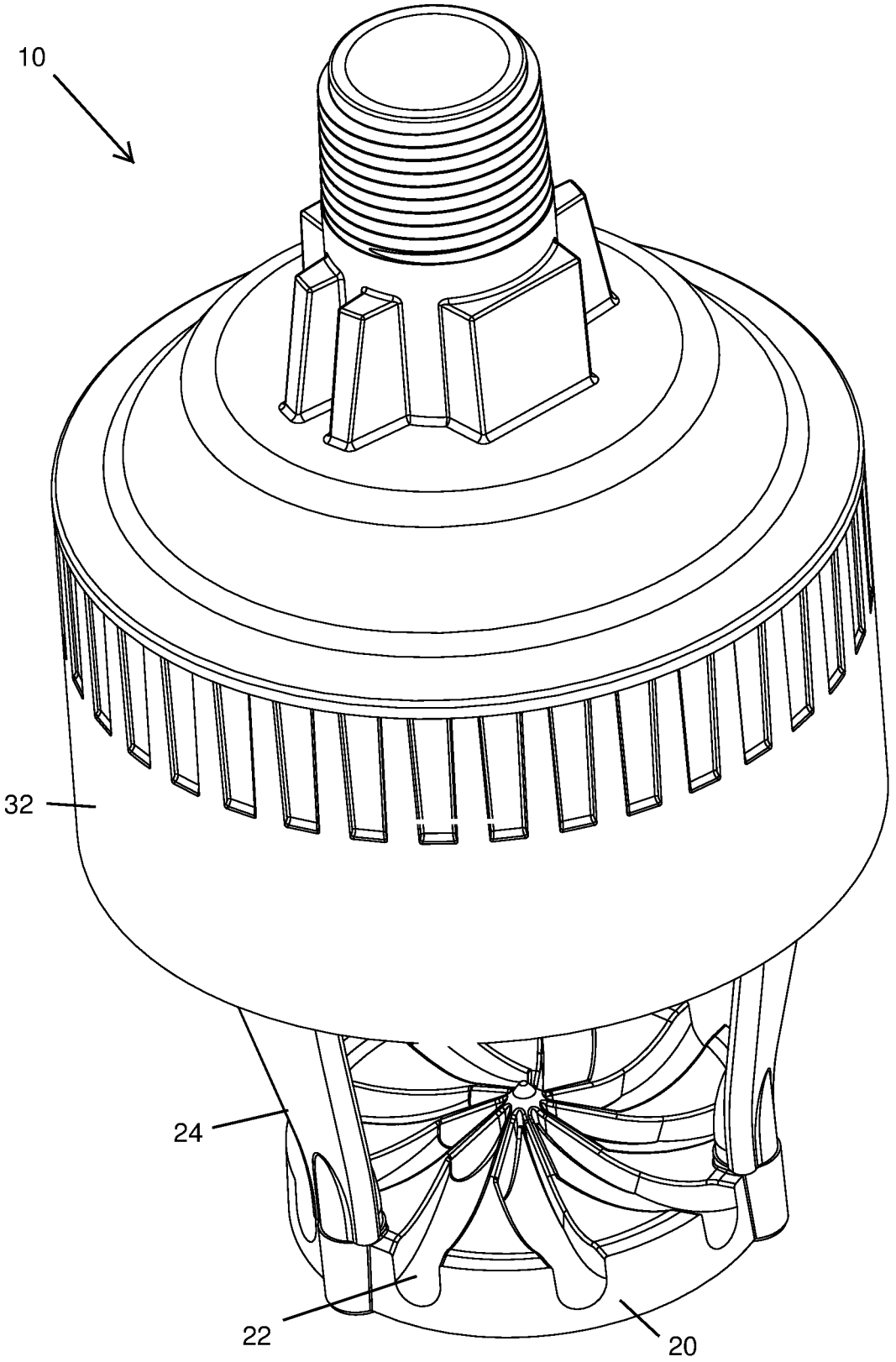
FIG. 3 is a top perspective view of the sprinkler with a nutating deflector assembly of FIG. 1A.
Figure 4:
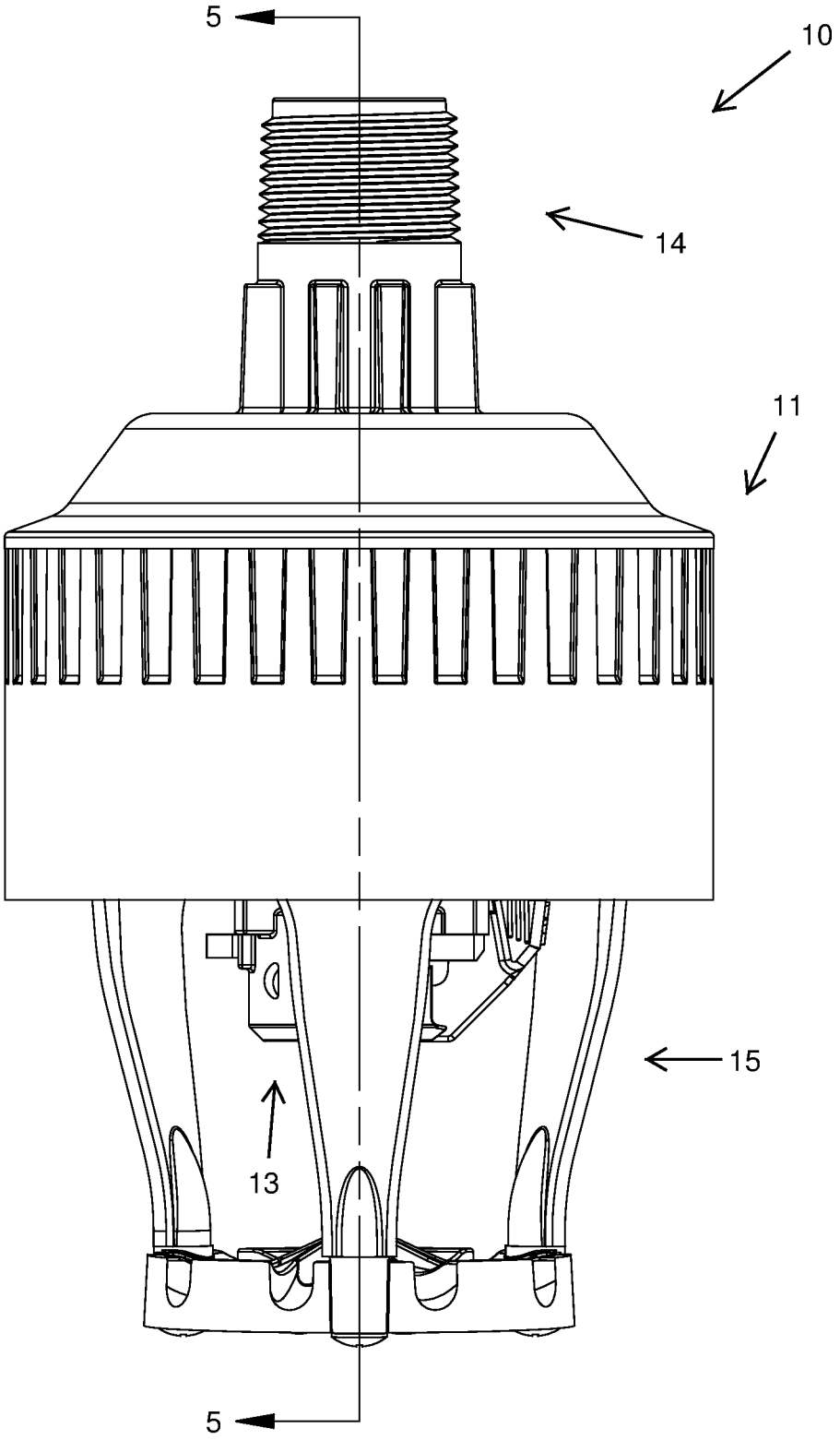
FIG. 4 is a left side plan view of the sprinkler with a nutating deflector assembly of FIG. 1A.

Referring to FIGS. 2-4, the nozzle assembly 13 may comprise a nozzle 18 that directs pressurized water from the inlet 14. For example, the nozzle can direct water to a distribution plate 20 of the deflector assembly 15. In some embodiments, the distribution plate 20 is securely fastened to a cage 24 of the deflector assembly 15. The cage 24 can include one or more arms extending from an upstream portion of the deflector assembly 15 to the distribution plate 20. In some embodiments the distribution plate 20 may be removably attached to the cage 24. In some embodiments the distribution plate may be removably attached to the cage 24 with one or more attachment screws 21. In some embodiments, an attachment screw 21 may be installed at one or more of the arms of the cage 24. In some embodiments, the cage 24 may have three arms to connect with the distribution plate. In some embodiments the cage may have less than three arms. In some embodiments, the cage 24 may have more than three arms.

In some embodiments, the distribution plate 20 may include one or more grooves 22 (see FIG. 3). The one or more grooves 22 may channel the water exiting the nozzle 18 to be ejected in a controlled direction. In some embodiments, the one or more groves 22 may be radially angled to cause the distribution plate 20 and the cage 24 to rotate when the water from the nozzle 18 impinges the distribution plate 20. In some embodiments, the cage 24 is loosely coupled to a nozzle tube 26 and/or shroud assembly 11 such that the cage and distribution plate assembly will wobble (e.g., tilt, oscillate, bounce, shake, or otherwise move) and rotate when pressurized water from the nozzle 18 impinges the distribution plate 20.

Figure 5:
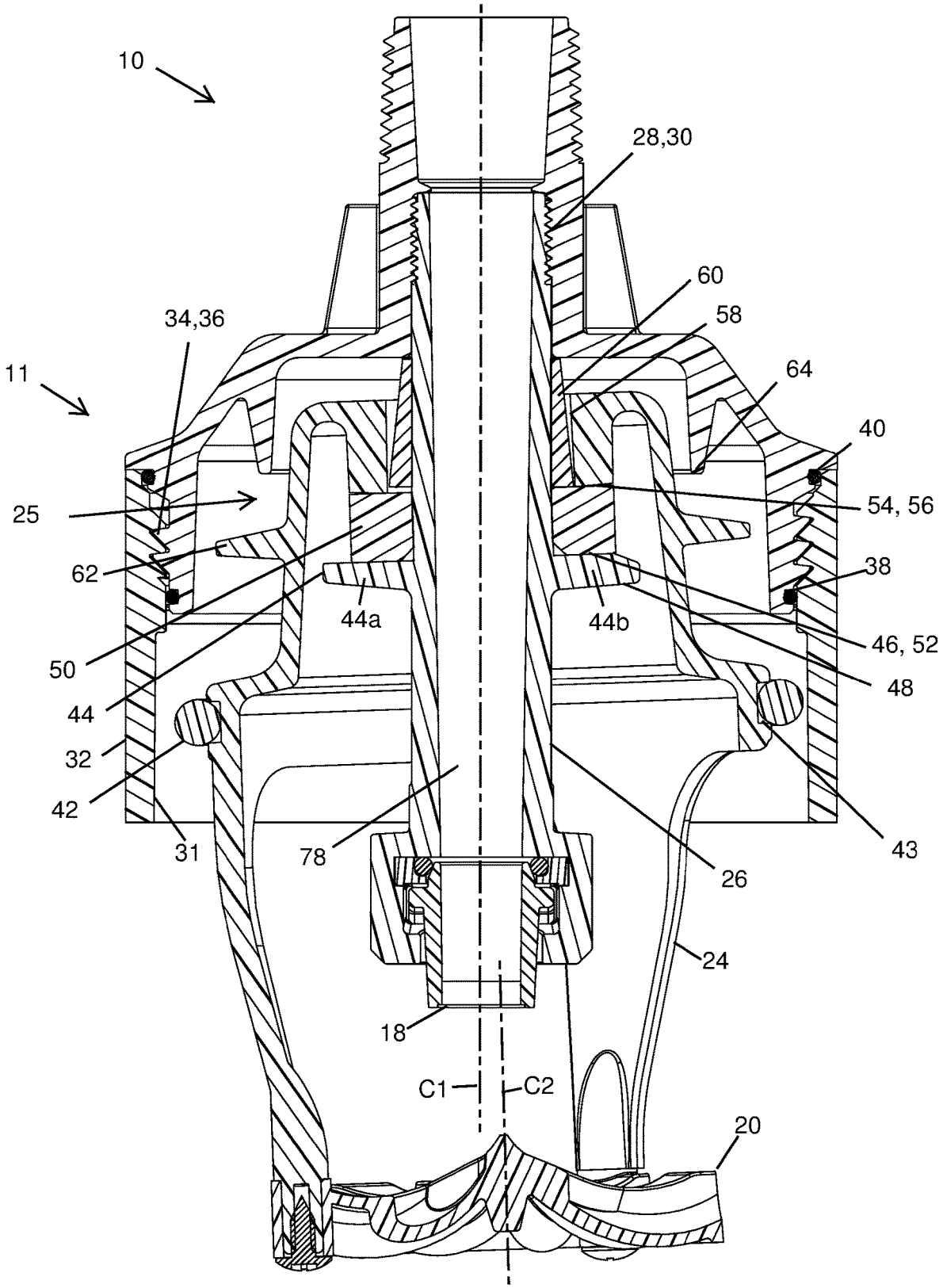
FIG. 5 is a cross-sectional view of the sprinkler with a nutating deflector assembly of FIG. 1A, as viewed along the cut-plane 5-5 of FIG. 4.

As illustrated in FIG. 5, the nozzle assembly 13 can include a nozzle tube 26. In an embodiment, the nozzle tube 26 may be removably connected to the shroud base 12 or the inlet 14. In some such embodiments, the nozzle tube 26 can be connected to and/or removed from the shroud assembly 11 without requiring tools. For example, the shroud base 12 may be manufactured with internal threads 28 and the nozzle tube 26 may have mating male threads 30 (e.g., on an upstream end of the nozzle tube 26). The nozzle tube 26 may be threaded into the shroud base 12. In some embodiments, a bayonet mount, snap ring, key, collar, pin or other attachment method may be used to securely fasten the nozzle tube 26 to the shroud base 12. The nozzle tube 26 can have an internal flow path that is straight, substantially straight, and/or tapered inward from the upstream end of the nozzle tube 26 to the downstream end of the nozzle tube 26.

Figure 8:
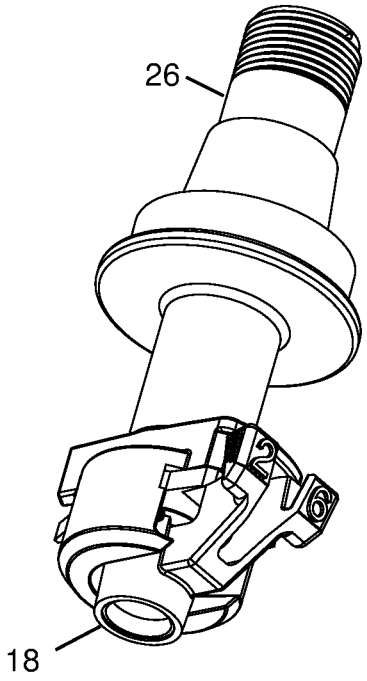
FIG. 8 is a bottom perspective view of the nozzle assembly of FIG. 7.
Figure 9:
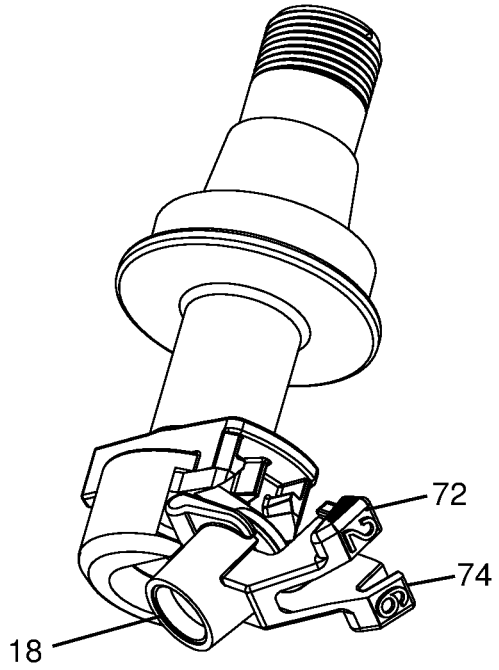
FIG. 9 is a bottom perspective view of the nozzle assembly of FIG. 7, wherein the nozzle is partially removed from the nozzle tube.

The downstream end of the nozzle tube 26 can be positioned beyond a downstream end of the shroud assembly 11 (e.g., below the lower end of a wear ring 32 in the frame of reference of FIG. 5). The downstream end of the nozzle assembly 13 can include a nozzle 18 that can be removed and installed to position on the nozzle tube 18 without any tools. As best viewed in FIGS. 8 and 9, a user may pinch the tabs 73 and 74 on the nozzle 18 when it is installed (FIG. 8) and may rotate it downwards (FIG. 9) to remove it. The nozzle 18 similarly can be replaced by reversing the procedure. In an embodiment, the nozzle may be similar to the nozzle disclosed in U.S. Pat. No. 8,556,196, titled QUICK CHANGE NOZZLE of Lawyer et. al., issued on Oct. 15, 2013, the entire content of which is incorporated by reference herein and made part of the present specification. The nozzle 18 can include an internal taper to accelerate and/or pressurize water flow out from the nozzle 18.

As illustrated in FIG. 5, the nozzle assembly 13 can include a deflector support structure configured to support the deflector assembly 15. For example, a support flange 44 may be formed around an outer diameter of the nozzle tube 26. The support flange 44 may completely surround a portion of the nozzle tube 26. In some embodiments, the support flange 44 may extend only partially around the nozzle tube 26 (e.g., the support flange 44 may include one or more gaps). The support flange 44 may have a first surface 46 (e.g., an upper surface when the nozzle 18 is directed downward) and a second surface 48 (e.g., a lower surface when the nozzle is directed downward). The deflector support structure may include a removable wear disc 50 having a first side 52 and a second side 54. As illustrated in FIG. 5, the wear disc 50 is supported by the support flange 44. The wear disc 50 can be sized, positioned, shaped, and/or otherwise configured to support the deflector assembly 15.

The deflector assembly 15 can include an upstream portion 25 (e.g., an upper portion when the nozzle 18 is directed downward). The upstream portion 25 of the deflector assembly 15 can be connected to the arm(s) of the cage 24. The upstream portion 25, or some other portion of the deflector assembly 15, can include a supporting surface 56 and an inner bearing surface 58. The wear disc 50 supports the deflector assembly 15 where the supporting surface 56 of the deflector assembly 15 sits on the upper surface 54 of the wear disc 50. The support flange may be formed so the top surface 46 is not perpendicular to the center axis C1 of the nozzle tube 26. As illustrated in FIG. 5, the support flange at one side (e.g., identified by 44*a*) is thinner than the support flange at an opposite side (e.g., identified by 44*b*). The tilt of the support flange 44 may be between 0° and 10° with respect to the center axis C1 of the nozzle tube 26. In some embodiments, the tilt of support flange is 2° with respect to the center axis C1 of the nozzle tube 26. In some embodiments, the outer surface of the nozzle tube 26 immediately above flange 44 is aligned perpendicular to the flange 44. For example, the portion of the nozzle tube 26 immediately upstream of the flange 44 can have an outer surface that is tilted with respect to the remainder of the outer surface of the nozzle tube 26. Aligning the outer surface of the nozzle tube 26 upstream of the flange 44 perpendicular to the flange 44 can facilitate use of a cylindrical wear disc 50 having a cylindrical inner bore which maintains contact with both the flange and the outer surface of the nozzle tube 26. For example, using a wear disc 50 having a flat bottom surface perpendicular to the central axis of the wear disc 50 may be used without losing contact with either or both of the outer surface of the nozzle tube 26 and the top surface 46 (e.g., tilted surface) of the flange 44. In some embodiments, the wear disc 50 is removable from the nozzle tube 26 without use of tools.

The wear disc 50 and the cage 24 are supported by the tilted surface 46 of the support flange 44. This causes the cage 24 and the center line C2 of the diffuser plate 20 to sit off axis of the center axis C1 when water is not being applied to the sprinkler 10. This may cause the water from the nozzle 18 to apply more force to one side of the distribution plate 20 and cause the cage 24 to move towards an opposite side of the wear ring 32 and start the nutating (e.g., rotating, tilting, and/or wobbling) action of the distribution plate immediately when the pressurized water is supplied to the sprinkler 10. In some embodiments, the pre-tilting of the diffuser plate 20 can reduce the likelihood of prolonged alignment between the center line C2 of the diffuser plate 20 and the center axis C1 of the nozzle tube 26. A removable tapered sleeve 60 can be positioned on top of the wear disc 50 and can serve as an inner bearing for the cage 24 to rotate and pivot around.

As illustrated in FIG. 5, the shroud assembly 11 includes a wear ring 32 (e.g., a shroud or skirt). The wear ring 32 can be connected to the shroud base 12. In some embodiments, the wear ring 32 surrounds at least a portion of both the nozzle tube 26 and the deflector assembly 15. A threaded portion 34 may be formed on the lower section of the shroud base 12. In some embodiments a threaded portion 36 may be formed on the upper portion of a wear ring 32. The wear ring 32 may be removably attached to the shroud base 12 by threading the wear ring 32 to the threaded portion of the shroud base 12. In some embodiments, the wear ring 32 may be removably attached to the shroud base 12 by using bayonet mounts, snap rings, keys, or collars or other attachment methods (e.g., attachment structures or methods that do not require use of tools or specialized tools for disconnection). In some embodiments, a sealing ring 38 may be installed between a surface of the bracket and a mating surface of the wear ring 32. In some embodiments, the sealing ring 38 may be manufactured of a pliable, elastic, resilient, and/or flexible material. In some embodiments, a second sealing ring 40 may be installed between a second surface of the bracket and a second mating surface of the wear ring. In some embodiments, the second sealing ring 40 may be manufactured of a pliable, elastic, resilient, and/or flexible material. In some embodiments one or both of the sealing rings 38 and 40 may be an O-ring. In some embodiments one or both of the sealing rings 38 and 40 my seal out at least a majority of the water to keep water and debris from collecting in the attachment area. In some embodiments one or both of the sealing rings 38 and 40 may provide a friction load to reduce the likelihood of the wear ring 32 detaching from the shroud base 12 during handling and normal operation.

In some embodiments, the deflector assembly 15 includes a contact portion configured to contact the wear ring 32. The contact portion may be positioned between the water inlet 14 and the distribution plate 20. The contact portion of the deflector assembly 15 can be configured to limit the degree of tilting of the distribution plate 20 with respect to the nozzle tube 26 during wobbling of the deflector assembly 15. In some embodiments, the contact portion may be integrally formed as part the deflector assembly 15. In some embodiments, the contact portion may be integrally formed as part the cage 24. In some embodiments, the contact portion can comprise a plurality of protrusions extending away from the cage axis. In some embodiments, the wear portion may be co-molded to the cage 24. In some embodiments, the contact portion of the deflector assembly can comprise a band 42 which may be installed in a groove 43 formed on the cage 24 or upstream portion 25 of the deflector assembly 15. In some embodiments, the band 42 may contact an inner surface 31 of the wear ring 32 during normal operation. In some cases, the wear ring 32 and the band 42 may restrict the angular movement of the cage 24 so the distribution plate is maintained in a correct position relative to the nozzle 18 during normal operation. In some embodiments, the band 42 may provide a resistive interface between the cage 24 and the wear ring 32 to slow or otherwise regulate the speed of rotation of the cage 24 and the distribution plate 20 during normal operation. In some embodiments, the band 42 may be a pliable, elastic, resilient, and/or flexible material that can cushion the impact of the cage 24 relative to the wear ring 32 during normal operation. In some embodiments, the band 42 may be an O-ring. In some embodiments, the grooves 22 may be formed to cause the rotation of the cage 24 and the band 42 to be such that the rotating band 42 contacting the inner surface 31 of the wear ring 32 will cause the wear ring to tighten at the threaded connection to the shroud base 12 thus reducing the likelihood of the wear ring 32 unthreading from the shroud base 12 during normal operation.

In some instances, it may be desirable to clean debris from the inner surface of the wear ring 32 or the outer surface of the band 42. To accomplish this, a user can simply unthread the wear ring 32 from the shroud base 12. With the wear ring removed, cleaning the desired surfaces is easily accomplished. The user can reassemble the cleaned wear ring 32 to resume normal operation. In some instances, the band 42 may wear out to a point where it needs to be replaced. In some cases the inner surface of the wear ring 32 can be damaged and needs to be replaced. Either of these two conditions can be easily remedied by unthreading the wear ring 32 form the shroud base 12 and replacing the component.

In some embodiments, the wear ring 32 may extend axially beyond any wear surfaces to shield the wear surfaces from contamination of debris or water that may be emitted from other sprinklers in proximity of the sprinkler 10. As best illustrated in FIG. 5, the wear ring 32 extends past the band 42. Additionally, the wear ring 32 reduces the likelihood of water or debris getting up to the wear disc 50. In some embodiments, a splash ring may be provided to reduce the intrusion of foreign matter in the upper area of the sprinkler 10. In an embodiment a splash ring 62 may be formed around an outer surface of the upstream portion 25 of the deflector assembly 15 to reduce the likelihood of water or debris from getting to the top of the cage area. In an embodiment, a splash ring 64 maybe formed to extend in an axial direction from an upstream inside surface of the shroud base 12 to restrict water and debris from contaminating the top of the cage area (e.g., the top of the upstream portion 25 when the nozzle 18 is directed downward). In some embodiment, the sizes of, and relative positions of, the splash ring 62, the splash ring 64 and the top of the upstream portion 25 of the deflector assembly 15 inhibit or prevent water from contaminating the upper cage area of the sprinkler 10. In some instances, reducing the likelihood of contamination of the upper cage area, including the bearing surface 58, the sleeve 60 and the upper surface 54 of the wear disc 50 can extend the life of the sprinkler 10. In some embodiments, the support flange 44 may extend radially outward of the nozzle tube to restrict the entry of water and debris to the wear disc 50.

Figure 6:
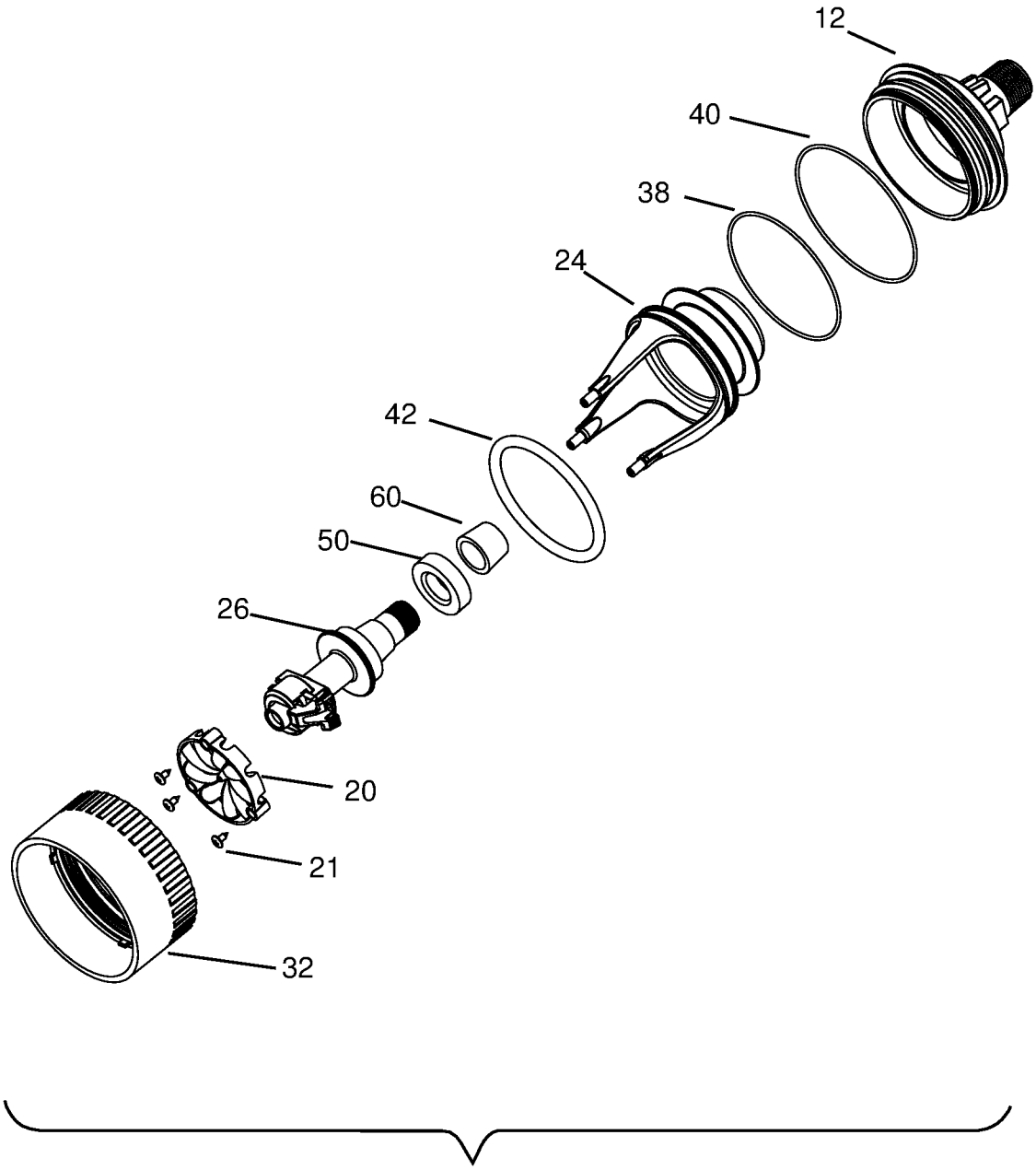
FIG. 6 is a perspective exploded view of the sprinkler with a nutating deflector assembly of FIG. 1A.

FIG. 6 illustrates an exploded view of the sprinkler 10. To disassemble the sprinkler 10 to service any worn or damaged parts, such as the nozzle tube 26, cage 24, wear ring 50, or sleeve 60, a user will first remove the attachment screws 21 and remove the distribution plate 20 from the cage 24. The user can then simply unscrew the nozzle tube 26 from the shroud base 12 and all of the internal components are accessible. A user can disassemble the wear ring 32 without any tools to replace or repair the wear ring 32, the seals 38 and 40, or the band 42. In some embodiments, the user can simply unscrew the wear ring 32 from the shroud base 12. It is clear from this illustration in FIG. 6 that every part of the sprinkler 10 can be serviced, cleaned, or replaced by a user with minimal tools and effort. The ability to service the sprinkler 10 in the field provides an important capability to the end user.

Figure 7:
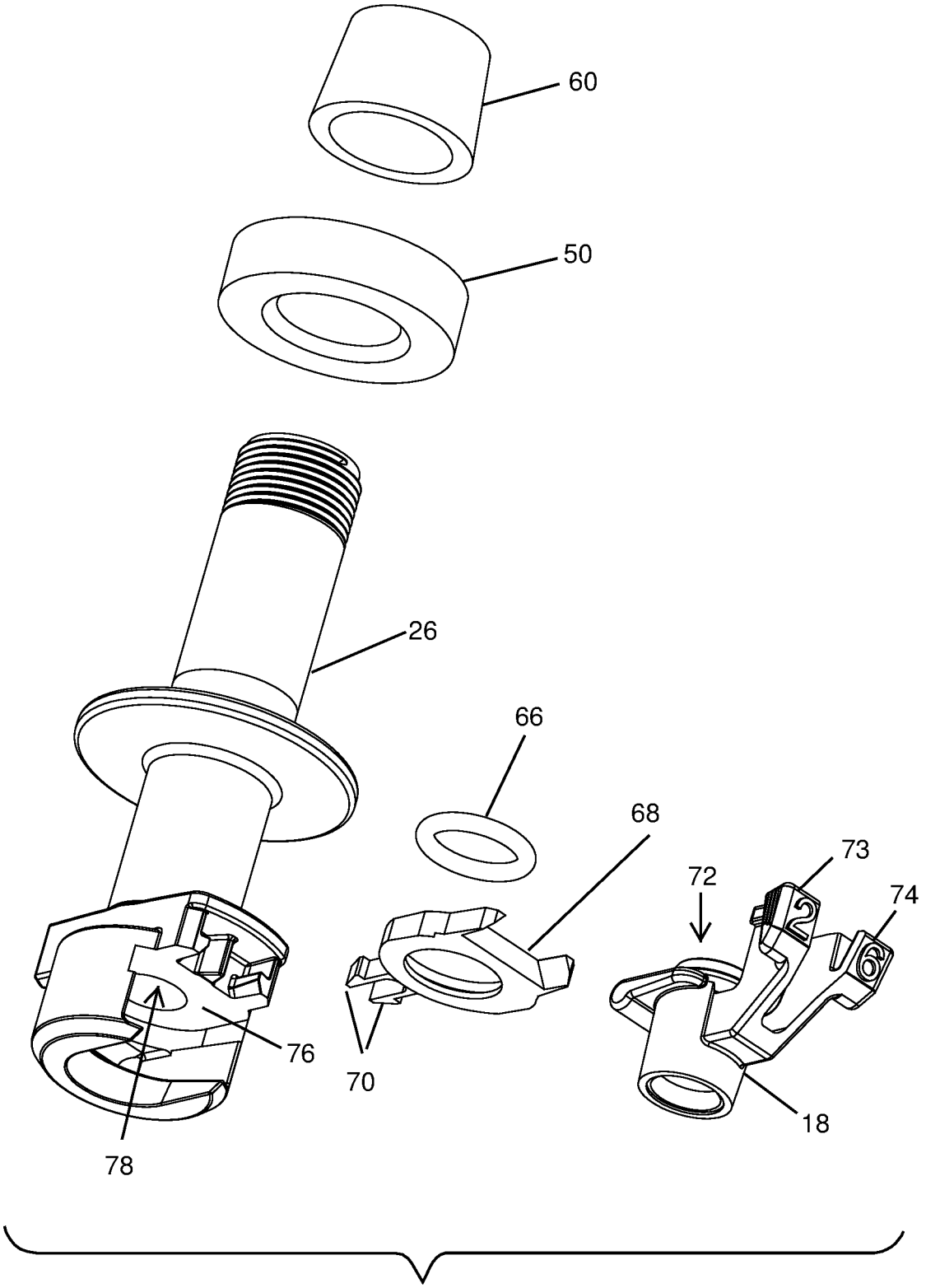
FIG. 7 is a perspective exploded view of an embodiment of a nozzle assembly.

FIG. 7 is an exploded view of the components mounted to the nozzle tube 26. The sleeve 60 and wear disc 50 may simply slide off and on over the nozzle tube 26. In an embodiment, an O-ring 66 may be installed into an O-ring tray 68. The O-ring tray 68 can snap into provided openings in the nozzle tube 26 to retain the O-ring 66 and the O-ring tray 68 in position to seal the inlet portion 72 of the nozzle 18. In some embodiments, locking tabs 70 may secure the O-ring tray 68 in place. In some embodiments, the O-ring tray 68 may be removable to facilitate service or replacement of the O-ring 66. For example, the O-ring tray 68 can be configured to load through a side of the nozzle tube 26. Side-loading the O-ring tray 68 can facilitate easy removal of the tray 68 while reducing interference from structures downstream of the tray 68. Side-loading the O-ring tray 68 can allow a user to reach between the arms of the cage 24 without interference from the distribution plate 20 when replacing the tray 68. In some embodiments, the O-ring 66 installed in the O-ring tray 68 may have a larger internal diameter that the internal bore 78 of the nozzle tube 26. The O-ring 66 may seal between the O-Ring tray 68 and a surface 76 that is perpendicular to the bore 78 of the of the nozzle tube 26.

Figure 10:
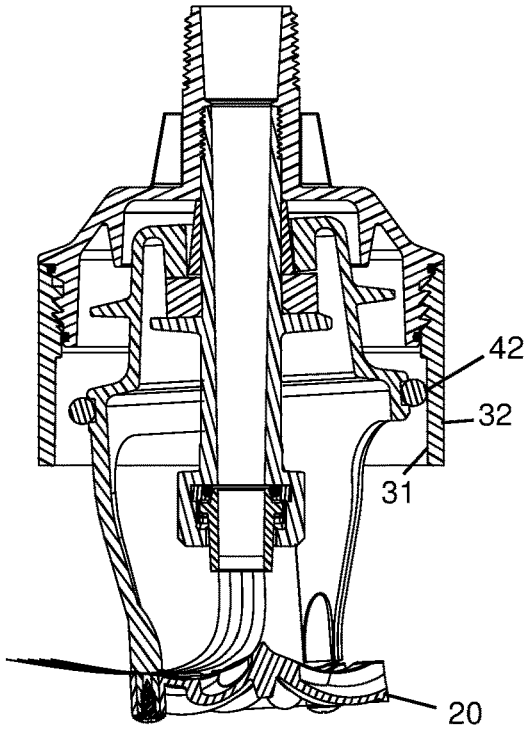
FIG. 10 is a cross-sectional view of the sprinkler with a nutating deflector assembly of FIG. 1A, as viewed along the cut-plane 5-5 of FIG. 4 when the deflector assembly is in a first tilt position.
Figure 11:
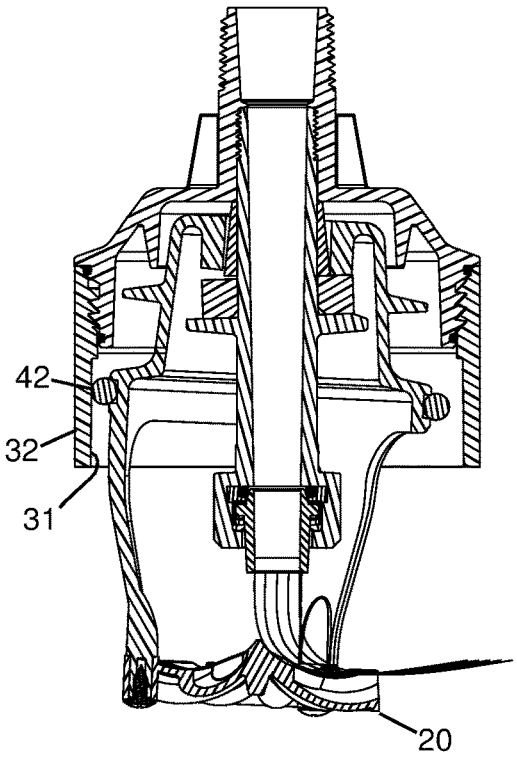
FIG. 11 is a cross-sectional view of the sprinkler with a nutating deflector assembly of FIG. 1A, as viewed along the cut-plane 5-5 of FIG. 4 when the deflector assembly is in a second tilt position.

As best illustrated in FIGS. 10 and 11, when water pressure is applied to the sprinkler 10, water from the nozzle 18 impinges the nutating distribution plate and causes it to move angularly to a first side. As illustrated in FIG. 10, the cage moves until the band 42 contacts the inner surface 31 of the wear ring 32. Additionally, the cage 24 and distribution plate 20 begin to rotate as a result of the water exiting the curved groves 22. As the cage 24 and distribution plate 20 rotate, water is dispersed in different directions. FIG. 10 illustrates the direction of water flow away from the distribution plate 20 when it is on a first position. FIG. 11 illustrates the direction of water flow after the cage 24 and distribution plate 20 have moved to a second position relative to the first position illustrated in FIG. 10. Continued rotation and movement from side to side of the distribution plate 20 in a nutating (wobbling) fashion produces a uniform water pattern on the plants being irrigated from the water exiting the nozzle 18 and impinging the distribution plate 20.

Figure 14:
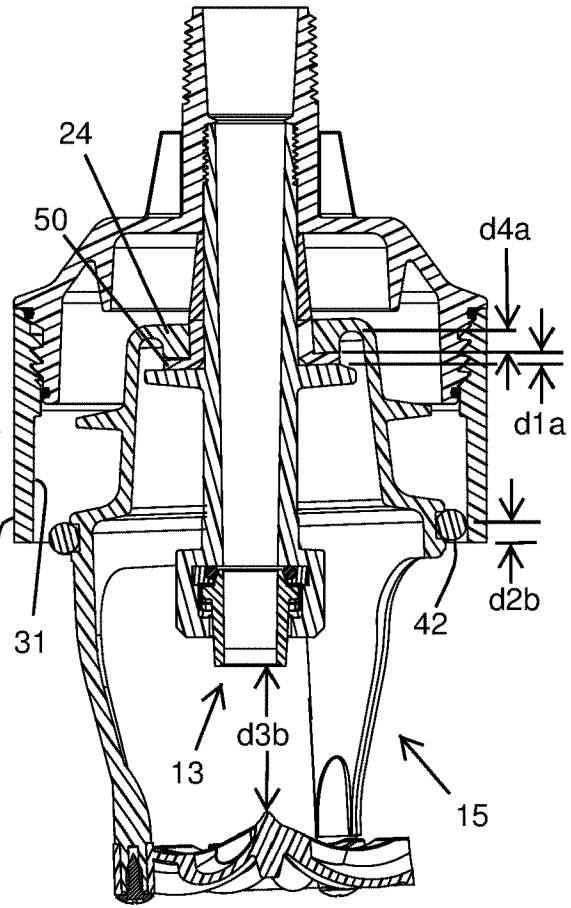
FIG. 14 is a cross-sectional view of the sprinkler with a nutating deflector assembly of FIG. 1A, as viewed along the cut-plane 5-5 of FIG. 4, wherein the wear disc and the cage are both worn down and in a "used" state.
Figure 13:
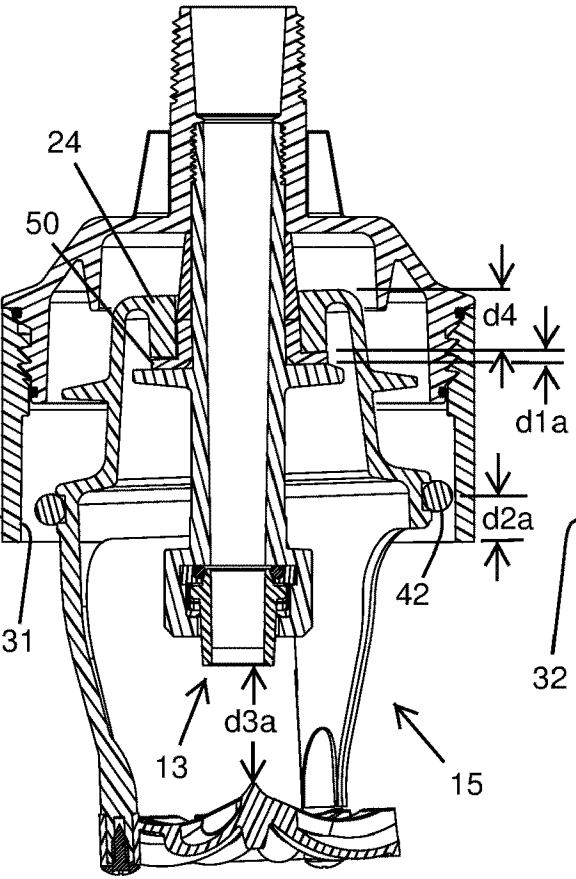
FIG. 13 is a cross-sectional view of the sprinkler with a nutating deflector assembly of FIG. 1A, as viewed along the cut-plane 5-5 of FIG. 4, wherein the wear disc is worn down and in a "used" state.
Figure 12:
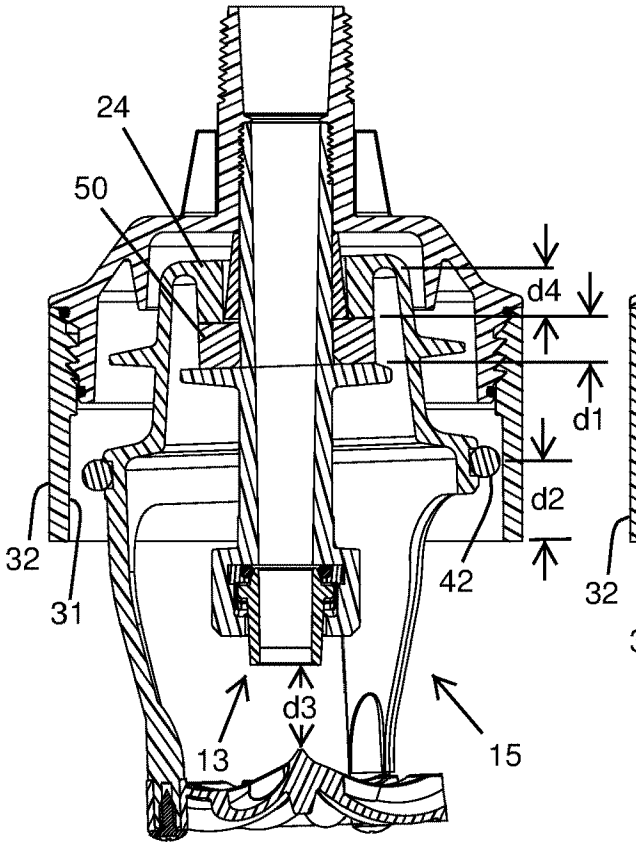
FIG. 12 is a cross-sectional view of the sprinkler with a nutating deflector assembly of FIG. 1A, as viewed along the cut-plane 5-5 of FIG. 4, wherein the wear disc is in a "new" state.

Referring to FIGS. 12, 13, and 14, the wear disc 50 may be manufactured from a material that is softer then the material used for the cage 24. In some embodiments, the movement of the cage 24 may cause the wear disc 50 to change in size due to friction and load. In some instances, as illustrated in FIG. 12, the cage 24 may be in a new condition as represented by dimension d4 and the wear disc 50 may be in new condition as represented by dimension d1 (e.g., the height of the new wear disc 50). When the cage 24 and the wear disc 50 are in new condition, the band 42 may contact the inner surface 31 of the wear ring 32 at a relatively high portion of the inner surface 31 as illustrated by dimension d2. In this condition, the distribution plate 20 may be at a first position at a relatively close proximity to the nozzle 18 as illustrated by dimension d3. In some instances as illustrated in FIG. 13 the wear disc 50 may be in a worn condition as represented by dimension d1*a*. When the wear disc is in a worn condition, the band 42 may contact the inner surface 31 of the wear ring 32 at a relatively lower portion of the inner surface 31 as illustrated by dimension d2*a*. In this condition, the distribution plate 20 may be at a second position further from the nozzle 18 than when the wear disc 50 was in the new condition, as illustrated by dimension d3. As the wear disc slowly erodes with use, the band 42 may contact the inner surface 31 of the wear ring 32 at different locations. As the contact location changes, wear on the inner surface 31 may occur in different places. This may prevent, or reduce the likelihood of wear grooves forming on the inner surface 31 of the wear ring 32. This action may extend the useful life of the inner surface 31 versus the wear that may occur if the contact area of the band 42 was always the same. In some embodiments, the wear disc 50 may be manufactured of a harder material than the cage 24 and the wear surface 56 of the cage 24 may wear against the wear disc 50. In some embodiments, both the wear disc 50 and the cage 24 may wear over time as illustrated in FIG. 14. In this instance, the as new condition of the upper portion of the cage 24 is shown as dimension d4 in FIGS. 12 and 13 and it is illustrated in its worn condition in FIG. 14 as depicted by dimension d4*a*. In this instance, the dimension d2*b* is even shorter than the dimension d2*a* illustrated in FIG. 13 and the distribution plate 20 is illustrated in a third position as depicted by dimension d3*b* even further from the nozzle than it was in the second position depicted as dimension d3*a* illustrated in FIG. 13. The sprinkler 10 sprays water to the wetted area whether the nutating distribution plate 20 is in the first position, the second position, the third position, or any position between the first position and the third position. In any of the above embodiments, one or more of the wear ring 50, and/or cage 24 may be easily replaced if substantially worn. The large wear portions of the sprinkler 10 provide an extended service life for the sprinkler 10. The ease of replacing any worn parts allow the useful service life of the sprinkler 10 to be extended even further.

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

For expository purposes, the term "horizontal" as used herein is defined as a plane parallel to the plane or surface of the floor or ground of the area in which the device being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Although the sprinkler has been disclosed in the context of certain embodiments and examples, it will be understood by those skilled in the art that the sprinkler and subassemblies extends beyond the specifically disclosed embodiments to other alternative embodiments and/or uses of the embodiments and certain modifications and equivalents thereof. For example, some embodiments are configured to operate oriented such that the distribution plate is positioned above the nozzle and the nozzle directs water upward. Accordingly, it is intended that the scope of the sprinkler herein-disclosed should not be limited by the particular disclosed embodiments described above, but should be determined only by a fair reading of the claims that follow.

What is claimed is:

1. A sprinkler assembly comprising:
- a water inlet;
- a nozzle assembly in fluid communication with the water inlet, the nozzle assembly including:
  - a nozzle tube having an upstream end and a downstream end;
  - a nozzle positioned at the downstream end of the nozzle tube and configured to direct water out from the nozzle tube along a nozzle axis; and
  - a user replaceable wear disc at least partially surrounding the nozzle tube at an intermediate position between the upstream and downstream ends of the nozzle tube, the wear disc having an upstream end and a downstream end;
- a deflector assembly connected to the nozzle assembly and including:
  - a distribution plate positioned downstream of the nozzle and configured to deflect water from the nozzle;
  - a cage having one or more arms connected to the distribution plate, the one or more arms extending from the distribution plate toward the upstream end of the nozzle tube; and
  - an upstream collar portion connected to the one or more aims and at least partially surrounding the nozzle tube, the upstream collar portion having one or more load surfaces configured to contact the wear disc;
- wherein:
  - the deflector assembly is configured to move with respect to the nozzle axis in one or both of a rotational and a tilting direction;
  - the wear disc is configured to bear at least a majority of a weight of the deflector assembly; and
  - the downstream end of the wear disc is prevented from moving toward the nozzle during movement of the deflector assembly.

2. The sprinkler assembly of claim 1, further comprising a shroud connected to the water inlet and surrounding at least a portion of the nozzle tube, the shroud having a first end and a second end positioned further from the water inlet than the first end.

3. The sprinkler assembly of claim 2, wherein the shroud includes a base portion connected to the water inlet and a removable ring connected to the base portion.

4. The sprinkler assembly of claim 3, wherein the removable ring is connected to the base portion via a threaded engagement.

5. The sprinkler assembly of claim 3, wherein the deflector assembly comprises a contact portion configured to periodically contact the removable ring during movement of the deflector assembly with respect to the nozzle axis.

6. The sprinkler assembly of claim 5, wherein no portion of the deflector assembly other than the contact portion contacts the shroud during movement of the deflector assembly with respect to the nozzle axis.

7. The sprinkler assembly of claim 5, wherein the contact portion is an annular band.

8. A sprinkler assembly comprising:
- a nozzle tube having an upstream end connected to a water inlet and a downstream end configured to eject water along a nozzle ejection axis;
- a deflector assembly including:
  - a longitudinal axis;
  - a distribution plate positioned along the longitudinal axis;
  - an upstream portion surrounding a portion of the nozzle tube and supported by the nozzle tube;
  - at least one arm connecting the upstream portion to the distribution plate; and
  - a deflector collar extending at least partially around the deflector assembly; and
- a shroud connected to the nozzle tube and including:
  - a base portion connected to the water inlet; and
  - a wear ring removably connected to the base portion and extending from the base portion in a direction opposite the water inlet, the wear ring having a generally cylindrical inner wall;
- wherein:
  - the deflector assembly is configured to tilt with respect to the nozzle ejection axis such that the longitudinal axis of the deflector assembly is misaligned from the nozzle ejection axis in a plurality of orientations during movement of the deflector assembly; and
  - the deflector collar is configured to contact the inner wall of the wear ring to limit misalignment between the longitudinal axis of the deflector assembly and the nozzle ejection axis.

9. The sprinkler assembly of claim 8, wherein the wear ring extends downstream of the base portion to shield wear surfaces from contamination.

10. A sprinkler assembly comprising:
- a nozzle configured to output water along a nozzle ejection axis;
- a deflector assembly including:
  - a longitudinal axis;
  - a distribution plate positioned along the longitudinal axis;
  - an upstream portion;
  - at least one arm connecting the upstream portion to the distribution plate; and
- a wear disc having an upstream end and a downstream end, the wear disc positioned between the upstream portion of the deflector assembly and the nozzle;
- wherein:
  - the deflector assembly is configured to tilt with respect to the nozzle ejection axis such that the longitudinal axis of the deflector assembly is misaligned from the nozzle ejection axis in a plurality of orientations during movement of the deflector assembly;

the upstream portion of the deflector assembly contacts the upstream end of the wear disc;

the wear disc is configured to support at least a majority of the weight of the deflector assembly; and the wear disc is constructed from a material softer than the upstream portion of the deflector assembly.

11. The sprinkler assembly of claim 10, further comprising a nozzle tube extending between a water inlet and the nozzle, wherein the nozzle is removably connected to the nozzle tube.

12. The sprinkler assembly of claim 11, wherein the nozzle tube further comprises an outward flange, wherein the wear disc is configured to surround a portion of the nozzle tube and to be supported by the outward flange.

13. The sprinkler assembly of claim 12, wherein the outward flange comprises an upstream surface upon which the wear disc is configured to sit, wherein the upstream surface of the outward flange is not perpendicular to the nozzle ejection axis.

14. The sprinkler assembly of claim 11, wherein the nozzle is configured to be removed from the nozzle tube in a direction non-parallel to the nozzle ejection axis.

15. The sprinkler assembly of claim 10, wherein the distribution plate is configured to move in one or both of a tilting direction and a rotating direction with respect to the nozzle ejection axis in reaction to impingement of water on the distribution plate.

16. The sprinkler assembly of claim 10, further comprising:

a nozzle tube extending between a water inlet and the nozzle; and a shroud supported by the water inlet and having a wear ring.

17. The sprinkler assembly of claim 16, wherein the deflector assembly further comprises a contact portion configured to contact the wear ring during movement of the deflector assembly with respect to the nozzle ejection axis.

* * * * *